US007537479B2

(12) United States Patent
Miyamoto

(10) Patent No.: US 7,537,479 B2
(45) Date of Patent: May 26, 2009

(54) CONNECTOR

(75) Inventor: Toshifumi Miyamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/127,204

(22) Filed: May 27, 2008

(65) Prior Publication Data

US 2008/0299812 A1 Dec. 4, 2008

(30) Foreign Application Priority Data

May 31, 2007 (JP) ..... 2007-144676

(51) Int. Cl.
*H01R 13/68* (2006.01)

(52) U.S. Cl. ..... 439/468

(58) Field of Classification Search ..... 439/468, 439/473, 902, 731; 220/326
See application file for complete search history.

(56) References Cited

U.S. PATENT DOCUMENTS 5,259,785 A * 11/1993 Inaba et al. ..... 439/466
5,271,739 A 12/1993 Denlinger et al.
5,672,078 A * 9/1997 Fukamachi et al. ..... 439/701
5,947,762 A * 9/1999 Katsuma ..... 439/468
6,095,852 A * 8/2000 Gregory, II ..... 439/540.1

FOREIGN PATENT DOCUMENTS

DE 1 973 8749 A1 12/1998
JP 2600796 10/1999

* cited by examiner

*Primary Examiner*—Phuong K Dinh
(74) *Attorney, Agent, or Firm*—Gerald E. Hespos; Anthony J. Casella

(57) ABSTRACT

If resilient locking pieces (26) are displaced together with side walls (21) in disengaging directions from locking portions (13) due to an external force acting on a wire cover (20), guide projections (28R) formed on the side walls (21) try to be displaced in the same directions as projecting directions of restricting projections (29). However, as the guide projections (28R) are displaced, the restricting projections (29) and guide portions (14) are engaged in larger areas. Accordingly, even if the resilient locking pieces (26) are disengaged from the locking portions (13), the detachment of the wire cover (20) from a housing (10) can be reliably prevented by the engagement of the restricting projections (29) and the guide portions (14).

11 Claims, 6 Drawing Sheets

CONNECTOR

BACKGROUND OF THE INVENTION

1. Field of the Invention

The invention relates to a connector.

2. Description of the Related Art

Japanese Utility Model Registration No. 2600796 discloses such a connector that a wire cover is assembled with a housing to cover the rear surface of the housing and wires drawn out through the rear surface of the housing are turned to extend substantially in parallel with the rear surface of the housing inside the wire cover. In this connector, the wire cover is assembled in a direction orthogonal to the rear surface of the housing. By engaging guide projections formed on the wire cover with guide portions of the housing, the wire cover can be stably assembled while being positioned to a proper position with respect to the housing. Further, the detachment of the wire cover from the housing is prevented by engaging resilient locking pieces formed on the wire cover with locking portions of the housing.

In the above connector, when an external force such as a tensile force acts on the wire drawn out from the wire cover, a pressing force is exerted from the wire to the wire cover in a detaching direction from the housing in some cases. In such cases, the resilient locking pieces are resiliently deformed to be disengaged from the locking portions by yielding to the pressing force, with the result that the wire cover may be detached from the housing.

Since the guide projections project in an assembling direction of the wire cover with the housing, a function of preventing the detachment of the wire cover from the housing cannot be expected from the engaging structure of the guide projections and the guide portions.

The invention was developed in view of the above situation and an object thereof is to prevent a wire cover from being detached from a housing.

SUMMARY OF THE INVENTION

The invention relates to a connector with a housing that has a draw out surface and wires that are drawn out through the draw-out surface. A wire cover is assembled with the housing to cover the draw-out surface in an assembling direction and at an angle to the draw-out surface. The wire cover turns the drawn-out wires at an angle to a draw-out direction of the wires from the housing. Resilient locking pieces are formed on one or more side walls of the wire cover and are deformable in directions substantially orthogonal to the assembling direction of the wire cover with the housing. One or more locks are formed on the housing and engage the resilient locking pieces to prevent detachment of the wire cover from the housing. One or more guide projections are formed on the one or more side walls of the wire cover and project substantially in the assembling direction of the wire cover with the housing. One or more guides are formed on the housing and contact the guide projections substantially in the disengaging directions of the resilient locking pieces from the locks to position the wire cover with respect to the housing.

An external force on the wire cover could urge the side walls and the resilient locking pieces in directions that could disengage the locking pieces from the locks. Thus, the guide projections on the side walls try to displace substantially in the projecting directions of the restricting projections. However, the restricting projections and the guides are engaged in larger areas as the guide projections are displaced. Accordingly, the engagement of the restricting projections and the guides prevents the wire cover from detaching from the housing even if the resilient locking pieces are disengaged from the locks.

One or more restricting projections preferably project from the guide projections substantially in the disengaging directions of the resilient locking pieces from the locks and are engageable with the guides to restrict a displacement of the wire cover in a detaching direction from the housing.

The wire cover preferably is formed with a draw-out opening having an open plane substantially orthogonal to the side walls and adapted to draw out the wires turned in the wire cover to the outside of the wire cover.

Spaced apart guide projections preferably are arranged on the side walls along the draw-out surface of the housing.

The restricting projections preferably are formed only on the guide projections closest to the draw-out opening.

The wire may contact the opening edge of the draw-out opening and may exert a pressing force on the wire cover in the detaching direction from the housing. Thus, the wire may try to turn the wire cover at the draw-out opening. However, the restricting projections are formed on the guide projections closest to the draw-out opening and reliably prevent detachment of the wire cover.

The side walls and the guide projections are deformed resiliently as the restricting projections pass the guides during assembly of the wire cover with the housing. The resilient restoring forces of the side walls and the guide projections create resistance during assembly. However, the restricting projections preferably are formed only on the guide projections closest to the draw-out opening, and not on the other guide projections. Therefore, resistance while assembling the wire cover can be suppressed to a minimum level.

The locks and/or the guides preferably are arranged substantially in point symmetry with respect to an axis orthogonal to the draw-out surface or rear surface of the housing. Thus, the wire cover can be assembled with the housing in two orientations inverted from each other by 180°. Therefore, the wires can be turned in two opposite directions.

An amount of resilient deformation of the guide projections relative to the side walls preferably is smaller than an amount of resilient deformation of the resilient locking pieces. Thus, the guide projections can be displaced together with the side walls when the side walls are deformed resiliently.

A dimension of the guide recesses in a direction orthogonal to the assembling direction preferably is set such that guide projections can fit therein without shaking in a direction orthogonal to the assembling direction.

The locks on one side of the housing preferably are offset along the forward and backward directions with respect to the locks on the opposite side of the housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
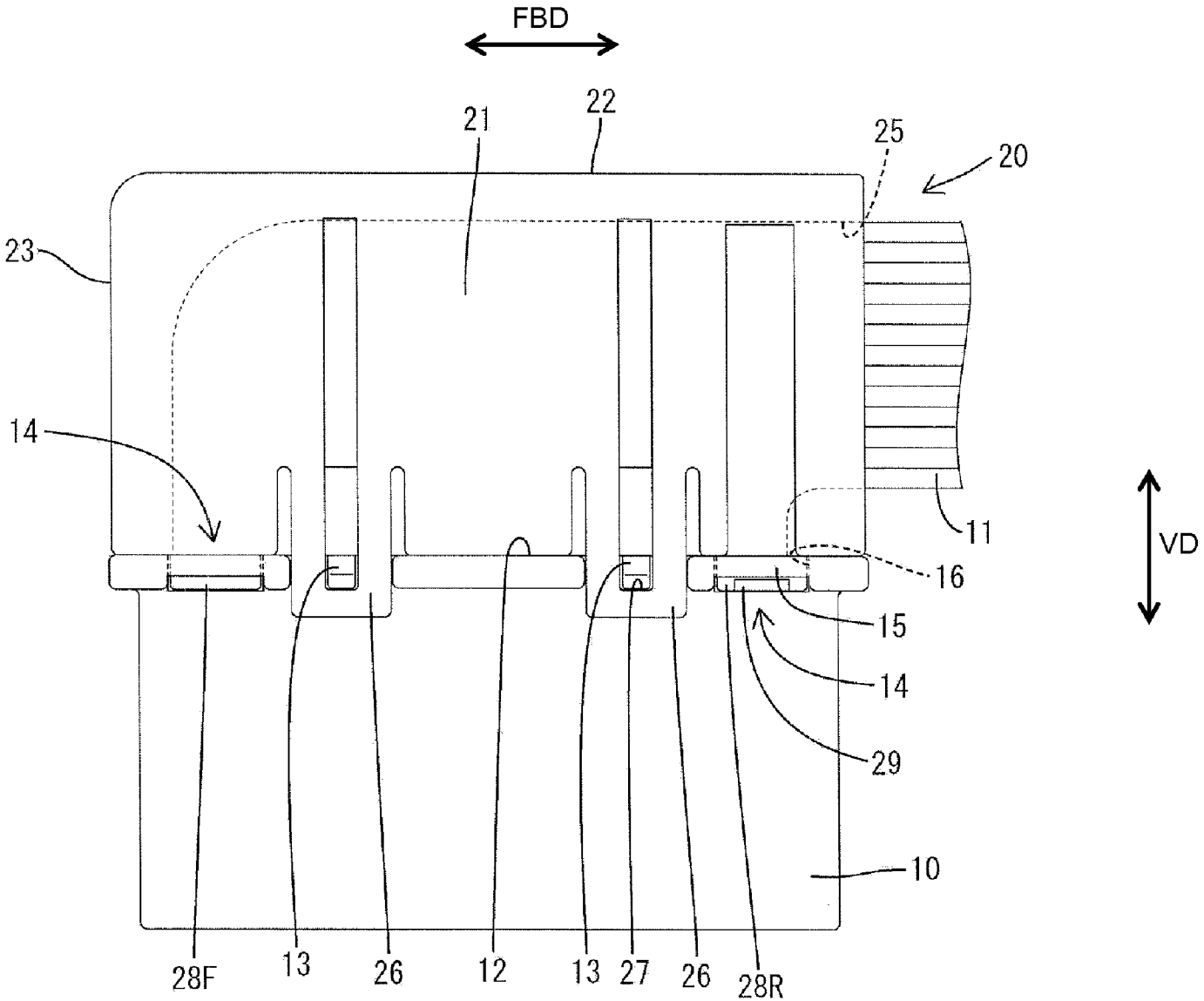
FIG. 1 is a side view of one embodiment.
Figure 2:
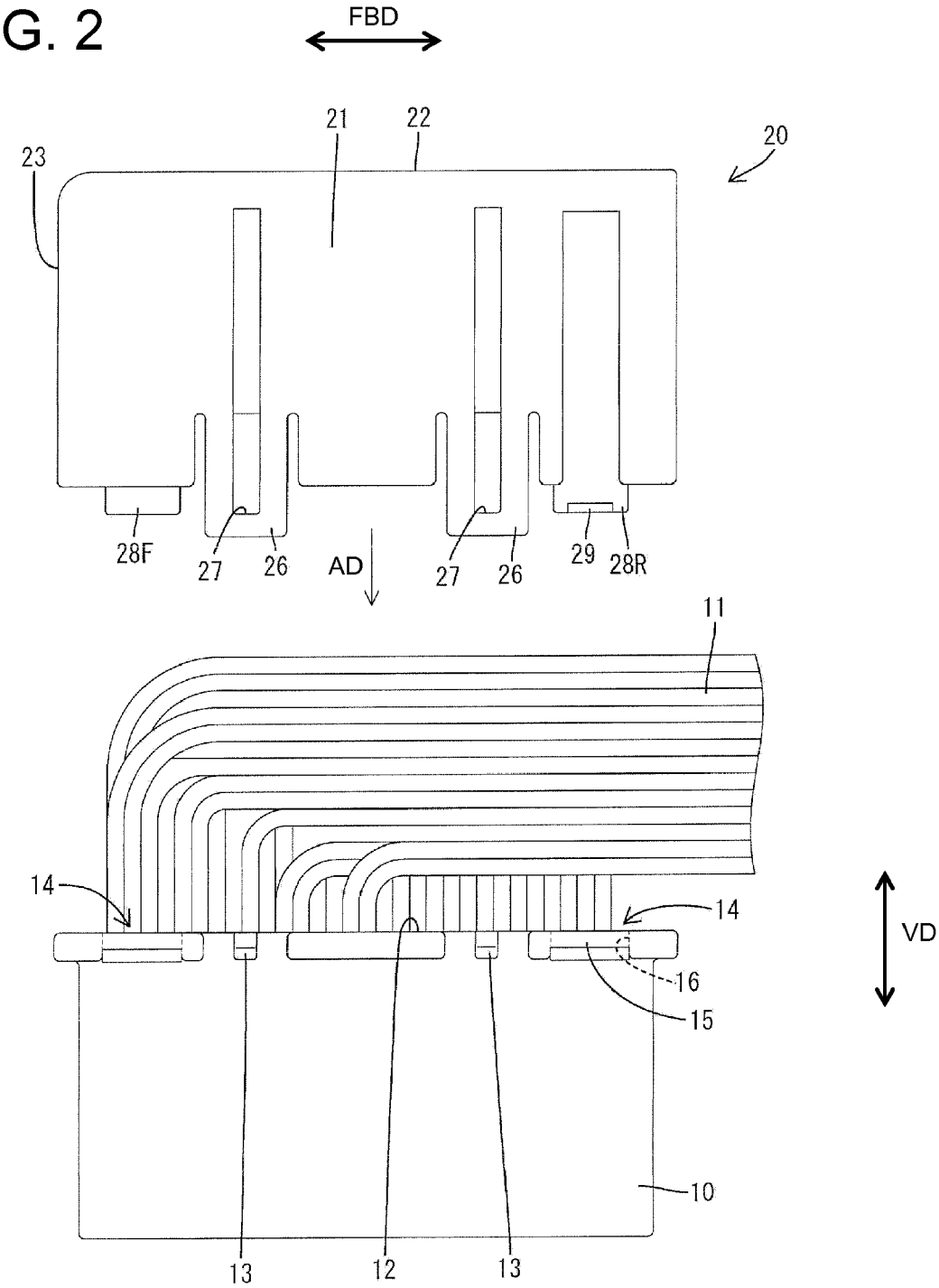
FIG. 2 is a side view showing a state where a wire cover is detached from a housing.
Figure 3:
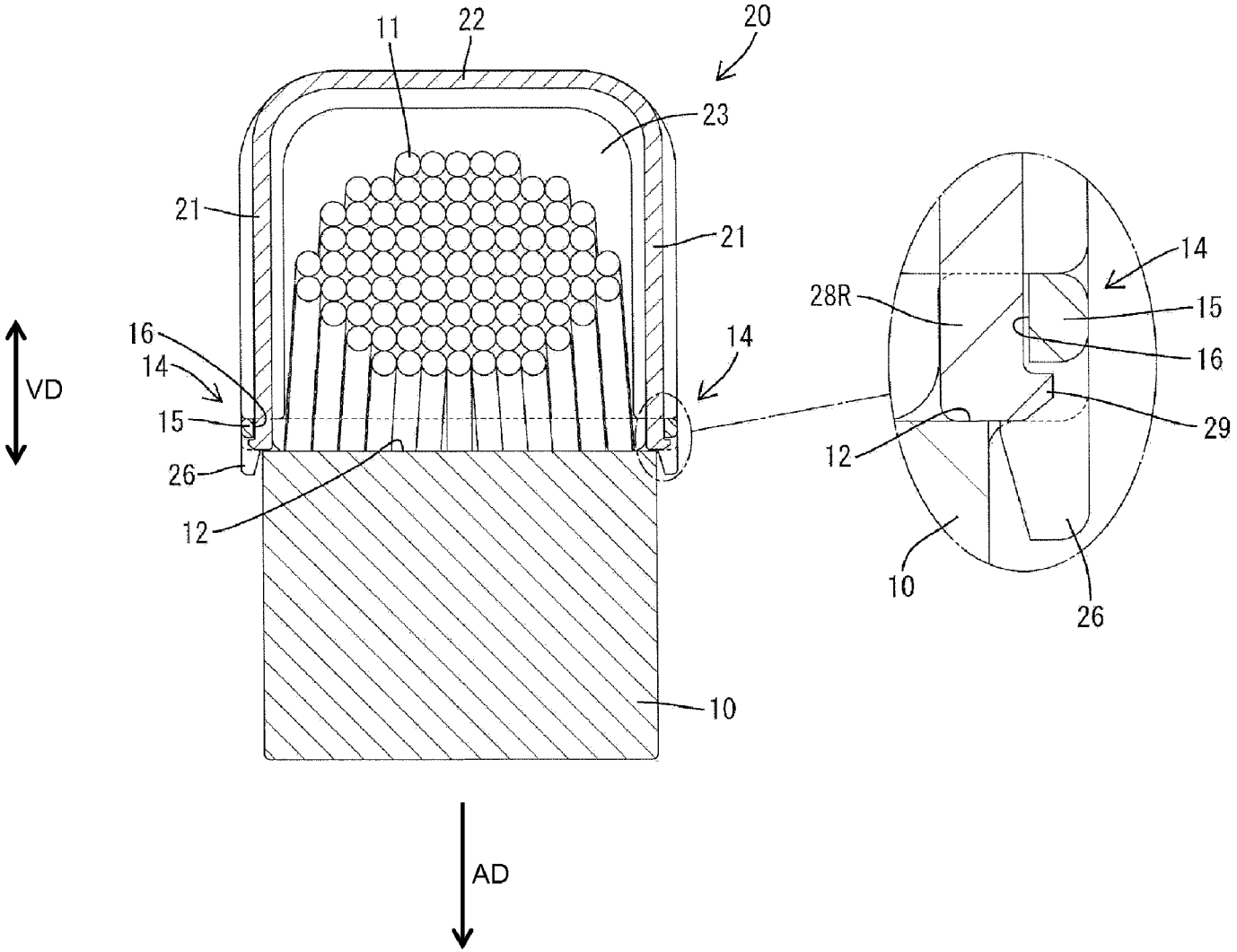
FIG. 3 is a section.
Figure 4:
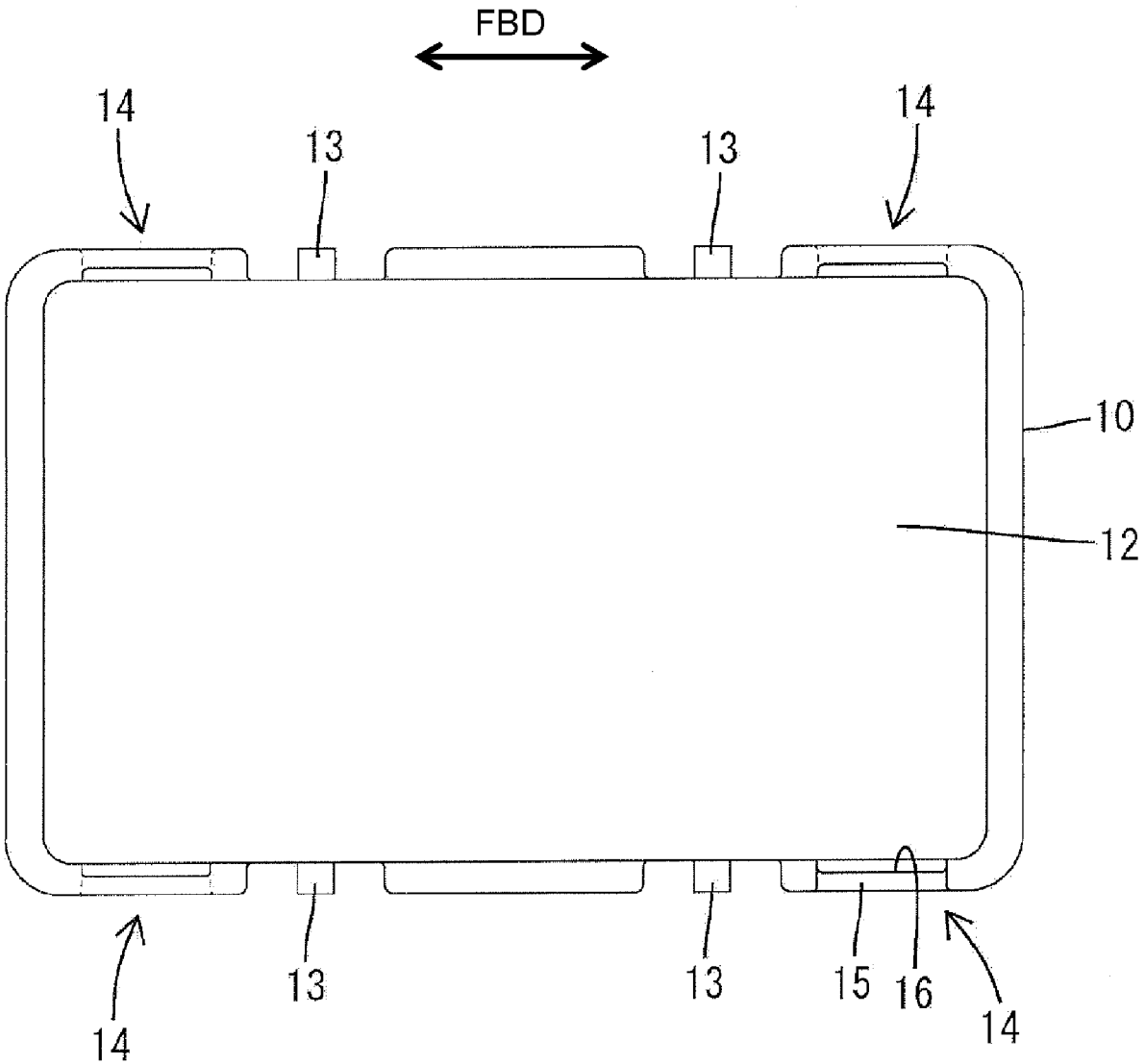
FIG. 4 is a plan view of the housing.
Figure 5:
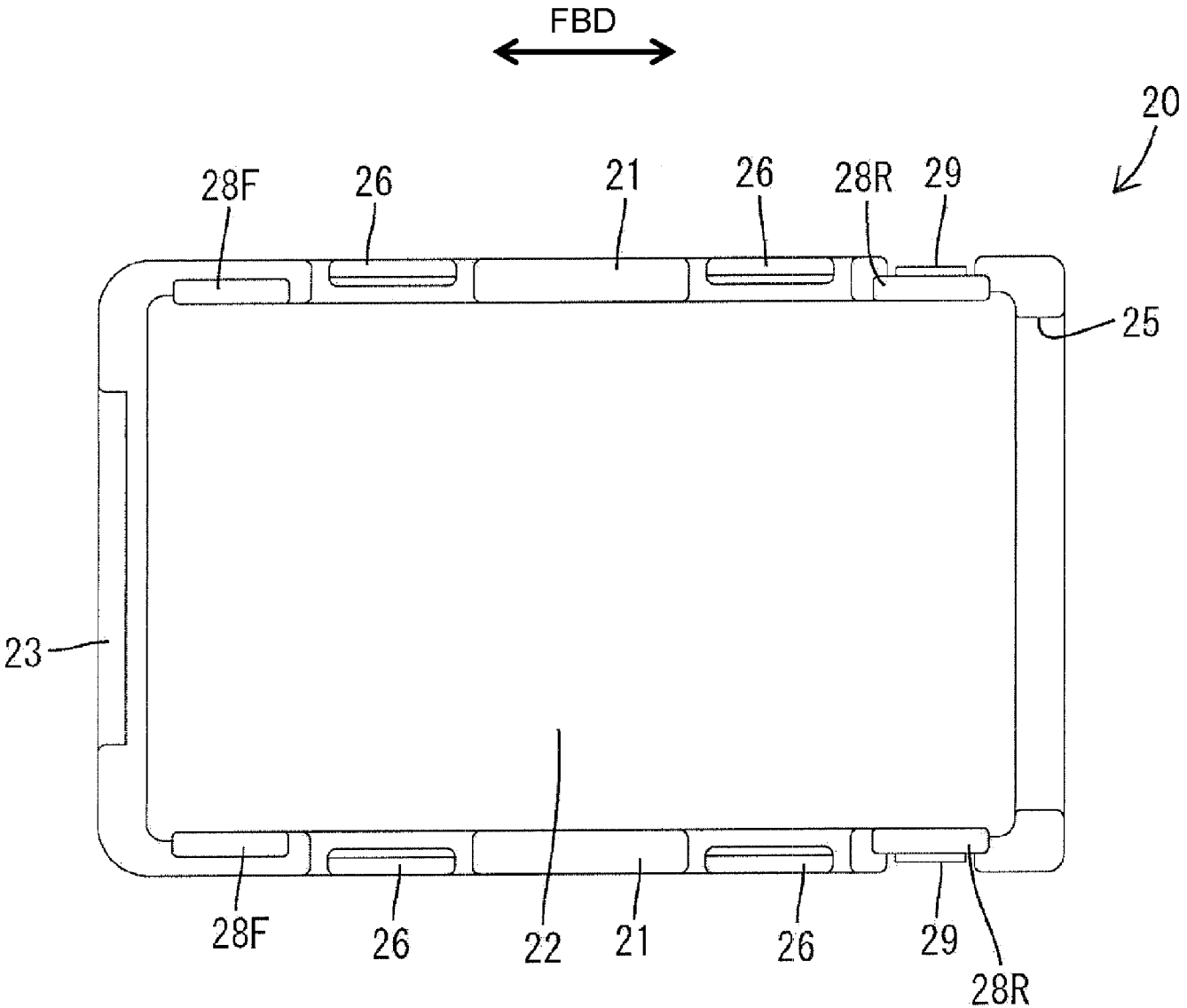
FIG. 5 is a bottom view of the wire cover.
Figure 6:
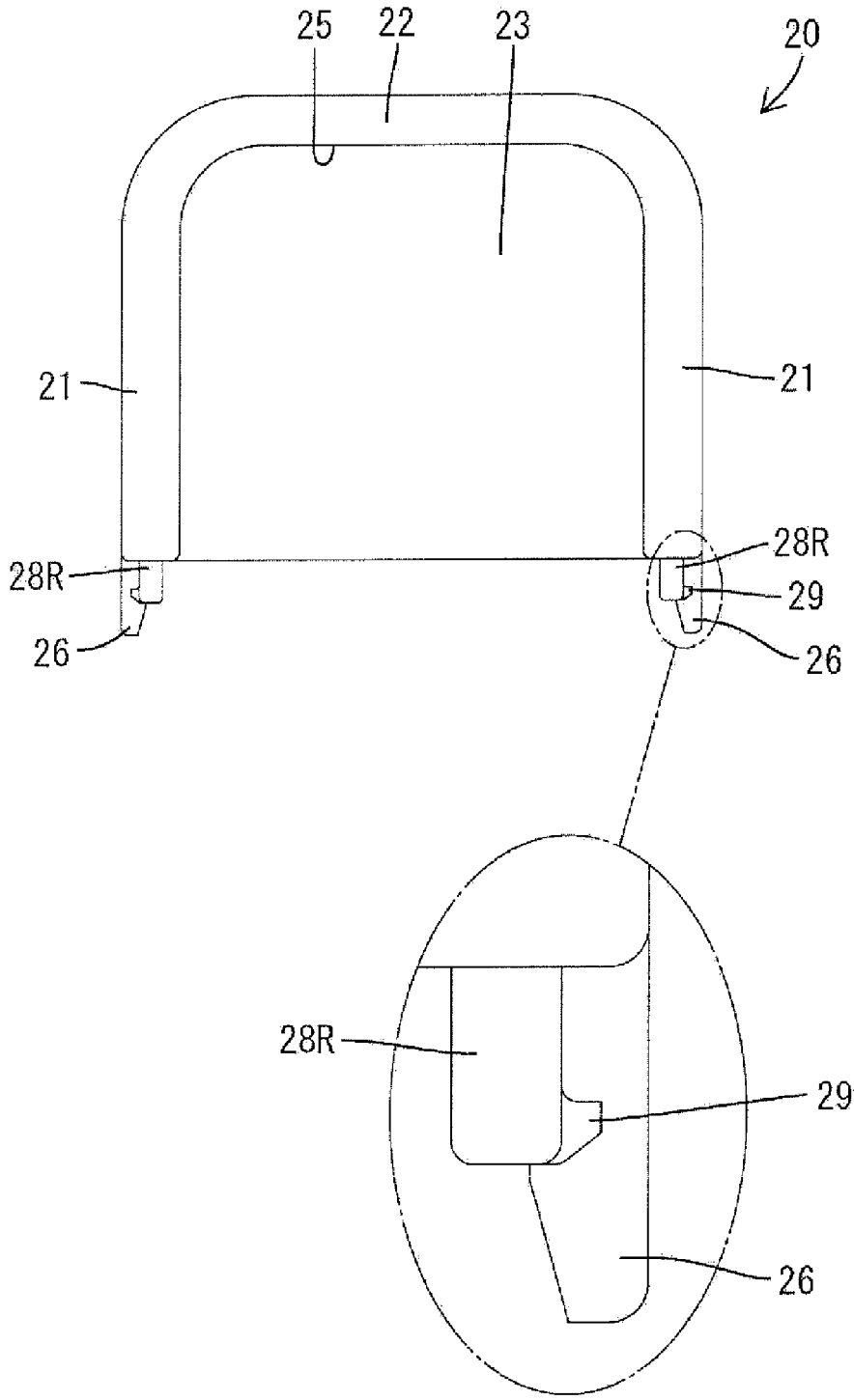
FIG. 6 is a rear view of the wire cover.

A connector according to the invention is described with reference to FIGS. 1 to 6. The connector has a housing 10 and a wire cover 20. In the following, the vertical direction VD and the forward and backward directions FBD correspond to the orientation shown in FIGS. 1 and 2.

The housing 10 is made e.g. of synthetic resin and is substantially in the form of a block that is long in forward and backward directions FBD. Terminal fittings (not shown) are inserted into the housing 10 through an upper surface 12 of the housing 10, and wires 11 connected with the respective terminal fittings are drawn out from the upper surface 12 of the housing 10 substantially at right angles to the upper surface 12. Accommodation spaces for the terminal fittings in the housing 10 are not shown in FIG. 4.

Locks 13 project on each of the left and right outer surfaces of the housing 10 at positions near the upper surface 12 and are spaced apart in forward and backward directions FBD. The front locks 13 (left ones in FIGS. 1 and 2) are closer to the center of the housing 10 than to the front end of the housing 10 and the rear locks 13 are closer to the center of the housing 10 than to the rear end of the housing 10. The locks 13 on one side of the housing 10 may be offset along the forward and backward directions FBD with respect to the locks on the other opposite side (see FIG. 4). The locks 13 project substantially orthogonal to an assembling direction AD of the wire cover 20 with the housing 10 and substantially orthogonal to the upper surface 12 of the housing 10. Two pairs of locks 13 are shaped and arranged in point symmetry with respect to an axis orthogonal to the upper surface 12 of the housing 10.

Front and rear guides 14 are formed on each of the left and right outer surfaces of the housing 10 substantially adjacent the upper surface 12 and at positions spaced apart in forward and backward directions FBD. The guides 14 are close to the front end and the rear end of the housing 10 so that the locks 13 are disposed between the guides 14. Each guide 14 includes a guide bar 15 and a guide recess 16. The guide bar 15 is narrow and long in a direction substantially parallel to the upper surface 12, and opposite front and rear ends thereof are supported on the housing 10. The guide recess 16 is formed by cutting out an inner surface of the guide bar 15 and is open forward and towards the upper surface 12 (upper and lower sides in FIGS. 1 to 3). An area of each guide bar 15 where the guide recess 16 is formed is more outward than the outer side surface of the housing 10. The two pairs of guides 14 are shaped and arranged in point symmetry with respect to the axis orthogonal to the upper surface 12 of the housing 10, similar to the locks 13.

The wire cover 20 is made e.g. of synthetic resin and includes two opposed side walls 21, an upper wall 22 connecting upper parts of the side walls 21 and a front wall 23 connecting front ends the opposite side walls 21. A turning space 24 is enclosed by the walls 21, 22 and 23 and is open at lower and rear ends facing the upper surface 12 of the housing 10 and at rear side (right side in FIGS. 1, 2 and 5). A draw-out opening 25 is defined at the rear of the turning space 24 for accommodating the turned wires 11 drawn out to the outside of the wire cover 20. The draw-out opening 25 has an open plane substantially orthogonal to the side walls 21. The side walls 21 are arranged along the opposite left and right edges of the upper surface 12 of the housing 10 and substantially at right angles to the upper surface 12 when the wire cover 20 is mounted on the housing 10. Accordingly, the wires drawn out from the upper surface 12 are bent to exit the wire cover 20 through the draw-out opening 25.

Resilient locking pieces 26 extend forward from the front end edges of the side walls 21 along the assembling direction AD of the wire cover 20 with the housing 10 and are flush with the side walls 21. The resilient locking pieces 26 can deform resiliently out relative to the side walls 21 and can move with the side walls 21 as the side walls 21 deflect. Additionally, the resilient locking pieces 26 are disposed in positions corresponding to the locks 13 of the housing 10. Locking holes 27 penetrate the resilient locking pieces 26 in inward and outward directions.

Front and rear guide projections 28F, 28R project forward from the front end edges of the side walls 21 in the assembling direction AD of the wire cover 20 with the housing 10. The guide projections 28F, 28R are substantially flush with the side walls 21, and have a wide rectangular side view. A forward projecting distance of the guide projections 28F, 28R from the side walls 21 is small, and an amount of resilient deformation of the guide projections 28F, 28R relative to the side walls 21 is very small (smaller than the resilient deformation of the resilient locking pieces 26). However, the guide projections 28F, 28R can be displaced together with the side walls 21 when the side walls 21 are deformed. Further, the guide projections 28F, 28R are close to the front and rear ends of the housing 10 and are in positions corresponding to the guides 14. Accordingly the resilient locking pieces 26 are between the guide projections 28F, 28R in forward and backward directions FBD.

Restricting projections 29 are on the outer surfaces of the projecting end of the guide projections 28R closer to the draw-out opening 25 and project in substantially the same direction as a disengaging direction of the resilient locking piece 26 from the lock 13. A projecting distance of the restricting projection 29 from the outer surface of the guide projection 28R is smaller than the thickness of the guide projection 28R.

To assemble the connector, the terminal fittings are inserted into the housing 10. The wire cover 20 then is brought closer to the upper surface 12 of the housing 10. The resilient locking pieces 26 of the wire cover 20 interfere with the locks 13 in the assembling process and deform out. The guide projections 28F, 28R then engage the respective guide recesses 16 to position the wire cover 20 with respect to the housing 10 in forward and backward directions FBD. The front end edge of the properly mounted wire cover 20 contacts the peripheral edge of the upper surface 12 of the housing 10. The resilient locking pieces 26 then resiliently restore so that the locking holes 27 engage the respective locks 13 for holding the wire cover 20 on the housing 10.

The restricting projections 29 interfere with the guide bars 15 of the guides 14 during the assembly of the wire cover 20. Thus, the rear guide projections 28R resiliently displace inwardly together with the side walls 21 and, simultaneously, the guides 14 resiliently displace outwardly. These resilient displacements are restored and the restricting projections 29 engage the guide bars 15 from below when the wire cover 20 reaches a properly assembled state. Displacement of the wire cover 20 in a detaching direction from the housing 10 is prevented by the engaging action of the restricting projections 29 and the guide bars 15.

Further, the wires 11 drawn out through the upper surface 12 of the housing 10 are bent in the turning space 24 with the wire cover 20 assembled on the housing 10 and are drawn out to the outside of the wire cover 20 through the draw-out opening 25 arranged substantially normal to the upper surface 12.

The wires 11 drawn out from the wire cover 20 may be pulled up while the wire cover 20 is assembled with the housing 10*a*. As a result, the wire 11 exerts a force on the opening edge of the draw-out opening 25 of the wire cover 20 in a direction away from the upper surface 12 of the housing 10. At this time, the resilient locking pieces 26 at the rear side may try to displace with the side walls 21 in disengaging directions from the locks 13 in response to the pressing forces. The guide projections 28R at rear positions on the side walls 21 also may try to displace in the same directions as the resilient locking pieces 26. The displacing directions are substantially the same as the projecting directions of the restricting projections 29 from the guide projections 28R. Thus, the restricting projections 29 and the guide bars 15 are engaged in larger areas as the guide projections 28R are displaced outwardly. Accordingly, even if the resilient locking pieces 26 are disengaged from the locks 13, the engaged state of the restricting projections 29 and the guides 14 is ensured. Therefore, detachment of the wire cover 20 from the housing 20 is prevented reliably.

A wire 11 that exerts a pressing force on the wire cover 20 in the detaching direction from the housing 10 will contact the opening edge of the draw-out opening 25 and will try to turn the wire 20 at the draw-out opening 25. Accordingly, the restricting projections 29 are formed only on the guide projections 28R closer to the draw-out opening 25. Thus, the engaging action of the restricting projections 29 and the guides 14 effectively resist a force against the pressing force acting on the draw-out opening 25 and reliably prevent the detachment of the wire cover 20.

Upon assembling the wire cover 20 with the housing 10, the side walls 21 and the guides 28R are deformed resiliently when the restricting projections 29 pass the guides 14. Thus, the resilient restoring forces of the side walls 21 and the guide projections 28R become resistance during assembly. However, the restricting projections 29 are formed only on the guide projections 28R closer to the draw-out opening 25, but not on the other guide projections 28F. Therefore, resistance caused during assembling the wire cover 20 is suppressed to a minimum level, which leads to good assembling operability.

The locks 13 and the guides 14 are arranged in substantially point symmetry with respect to the axis orthogonal to the upper surface 12 of the housing 10. Thus, the wire cover 20 can be assembled with the housing 10 in two orientations inverted by 180° in forward and backward directions FBD, and the wires 11 can be turned in two opposite directions.

The invention is not limited to the above described and illustrated embodiment. For example, the following embodiments are also embraced by the technical scope of the present invention as defined by the claims.

The restricting projections may be formed on all of the plurality of guide projections.

The locks and the guides may not be in point symmetry with respect to the axis orthogonal to the upper surface of the housing.

The number of the resilient locking pieces formed on one side wall may be one, three or more.

The number of the guide projections formed on one side wall may be one, three or more.

The locks may be arranged to locate the guides therebetween.

The resilient locking pieces may be arranged to locate the guide projections therebetween.

The locks may be formed on the inner surfaces of the housing and the resilient locking pieces may be engaged with the locks to be accommodated inside the housing. In such a case, the guides are located at the inner sides of the guide projections and the restricting projections project inwardly.

What is claimed is:

1. A connector, comprising:

a housing with a draw-out surface from which at least one wire can be drawn;

a wire cover to be assembled with the housing in an assembling direction at an angle to the draw-out surface for covering at least part of the draw-out surface and turning the drawn-out wires at an angle to a draw-out direction thereof from the housing;

at least one resilient locking piece formed on at least one side wall of the wire cover and resiliently deformable in directions substantially orthogonal to the assembling direction of the wire cover with the housing;

at least one lock formed on the housing and engageable with the resilient locking pieces for preventing detachment of the wire cover from the housing;

guide projections formed on the side wall of the wire cover and projecting substantially along the assembling direction of the wire cover with the housing, at least one of the guide projections being formed with a restricting projection projecting transverse to the assembling direction of the wire cover with the wire housing and in a direction in which the resilient locking piece is resiliently deformable for disengaging from the lock; and guides formed on the housing and adapted to position the wire cover with respect to the housing by contacting the guide projections substantially in disengaging directions of the resilient locking piece from the lock, the restriction projection being engageable with the corresponding guide to restrict a displacement of the wire cover in a detaching direction from the housing.

2. The connector of claim 1, wherein the wire cover is formed with a draw-out opening having an open plane substantially orthogonal to the side wall and adapted to draw out the wires turned in the wire cover to outside of the wire cover.

3. The connector of claim 2, wherein a plurality of spaced apart guide projections are arranged on the side wall along the draw-out surface of the housing.

4. The connector of claim 3, wherein the at least one restricting projection comprises a plurality of restricting projections are formed only on the guide projections closest to the draw-out opening.

5. The connector of claim 1, wherein the lock and the guide are arranged substantially symmetrically with respect to an axis orthogonal to the draw out surface of the housing.

6. The connector of claim 1, wherein an amount of resilient deformation of the guide projections relative to the side wall is smaller than an amount of resilient deformation of the resilient locking pieces, so that the guide projections can be displaced together with the side wall when the side wall is deformed resiliently.

7. The connector of claim 1, wherein the guide is formed with a guide recess that receives the guide projections, a dimension of the guide recesses in a direction substantially orthogonal to the assembling direction is set such that guide projections can be fit therein without shaking in a direction substantially orthogonal to the assembling direction.

8. A connector, comprising:

a housing with a wire draw-out end and outwardly facing side surfaces adjacent the wire draw-out end, locks projecting out from the side surfaces of the housing in proximity to the draw-out end, guides formed on the housing in proximity to the draw-out end at positions spaced from the locks; and a wire cover assembled with the housing for covering at least part of the draw-out end, resilient locking pieces formed on side walls of the wire cover and being disposed on the outwardly facing side surfaces of the housing, the resilient locking pieces being engaged with the locks to hold the wire cover on the housing and being deformable in directions away from the outwardly facing side surfaces of the housing, guide projections formed on the sidewall of the cover and being engaged with inwardly facing surfaces of the guides to position the wire cover with respect to the housing and to limit outward deformation of the side walls of the wire cover, a restricting projection projecting outwardly from at least one of the guide projections and being engageable with the guide to restrict a displacement of the wire cover from the housing.

9. The connector of claim 8, wherein the wire cover has a draw-out opening aligned substantially normal to the draw-out end of the housing, the restricting projections being formed only on the guide projections closest to the draw-out opening.

10. The connector of claim 8, wherein the lock and the guide are arranged substantially symmetrically with respect to an axis orthogonal to the draw out end of the housing.

11. The connector of claim 8, wherein an amount of resilient deformation of the guide projections relative to the side wall is smaller than an amount of resilient deformation of the resilient locking pieces, so that the guide projections can be displaced together with the side wall when the side wall is deformed resiliently.

* * * * *